US005482552A

United States Patent [19]

Kikukawa et al.

[11] Patent Number: 5,482,552

[45] Date of Patent: Jan. 9, 1996

[54] LIQUID METERING AND COATING DEVICE

[75] Inventors: Hiroyasu Kikukawa; Hiroshi Kato, both of Okayama, Japan

[73] Assignee: Japan GORE-TEX, Inc., Japan

[21] Appl. No.: 210,204

[22] Filed: Mar. 17, 1994

[30] Foreign Application Priority Data

Mar. 19, 1993 [JP] Japan ..... 5-085376

[51] Int. Cl.[6] ..... B05C 1/00

[52] U.S. Cl. ..... 118/264; 118/268; 118/DIG. 15; 355/284; 492/56

[58] Field of Search ..... 118/264, 268, 118/270, DIG. 15, 60; 492/56, 59; 355/284; 428/375, 391

[56] References Cited

U.S. PATENT DOCUMENTS

| | | | |
|---|---|---|---|
| 3,953,566 | 4/1976 | Gore | 264/505 |
| 3,962,153 | 6/1976 | Gore | 521/79 |
| 4,096,227 | 6/1978 | Gore | 264/110 |
| 4,187,390 | 2/1980 | Gore | 174/102 R |
| 4,522,866 | 6/1985 | Nishikawa et al. | 492/56 |
| 4,796,046 | 1/1989 | Suzuki et al. | 355/284 |
| 5,123,151 | 6/1992 | Uehara et al. | 492/56 |
| 5,180,899 | 1/1993 | Inasaki | 219/469 |
| 5,232,499 | 8/1993 | Kato et al. | 118/244 |

FOREIGN PATENT DOCUMENTS

| | | |
|---|---|---|
| 58-17129 | 2/1983 | Japan . |
| 61-245178 | 10/1986 | Japan . |
| 62-178992 | 6/1987 | Japan . |

*Primary Examiner*—Peter Chin
*Assistant Examiner*—Laura E. Edwards
*Attorney, Agent, or Firm*—Gary A. Samuels

[57] ABSTRACT

A liquid metering and coating device made of a liquid permeation control material including porous polytetrafluoroethylene, adhered to a porous support material of open-celled foam. The porous support and permeation control material contain mixtures of silicone oil and silicone rubber which bond to the porous support material and form an interconnected network of silicone rubber throughout the device. The device is suitable for use as a part of a toner fixation mechanism in a plain paper copying machine.

12 Claims, 2 Drawing Sheets

LIQUID METERING AND COATING DEVICE

FIELD OF THE INVENTION

The present invention relates to materials and devices for coating controlled amounts of liquids on to rolls or other surfaces, more particularly to devices for coating release liquids on the surface of rolls in toner fixation assemblies of plain paper copying machines.

BACKGROUND OF THE INVENTION

In a plain-paper copying (PPC) machine toner images applied to the surface of paper or other recording medium are fixated by application of heat and pressure. In certain PPC machines fixation is accomplished by passing the image-bearing recording medium between a hot thermal-fixation roll and a pressure roll. When this type of thermal-fixation device is used the toner material is directly contacted by a roll surface and a portion of the toner adheres to the roll surface. With subsequent rotation of the roll the adhered toner material may be redeposited on the recording medium resulting in undesirable offset images, stains, or smears; or, in severe cases, the recording medium may stick to the adhered toner material on the roll and become wrapped around the roll.

To counter these problems materials having good release properties such as silicone rubber or polytetrafluoroethylene are often used for the roll surfaces. Although improving performance of the thermal fixation devices, use of silicone rubber or polytetrafluoroethylene roll surfaces alone do not eliminate the problems. Another approach used to counter the problems is to include release agents with the toner materials to prevent them from adhering to the roll surface. These oilless toners also improve performance of the thermal-fixation devices but again, particularly in the case of high-speed type copying machines, do not completely eliminate the problems associated with toner pickup and transfer.

Toner pickup by the rolls can be controlled by coating the surface of at least one of the rolls of a thermal fixation device with a liquid release agent, such as a silicone oil. It is important that the release liquid be applied uniformly and in precise quantities to the surface of the roll. Too little liquid, or non-uniform surface coverage, will not prevent the toner from being picked up and redeposited on the roll. On the other hand, excessive quantities of the release liquid may cause silicone rubber roll surfaces to swell and wrinkle, thus producing copies of unacceptable quality. Furthermore, procedures intended to accommodate excess liquids by wiping or scraping them from the roll surface do not always produce favorable results and, in some cases, the efforts result in static electricity that causes further problems.

Devices to uniformly meter and coat a release liquid on copy machine roll surfaces are described in Japanese Laid-Open Patent Application Publication No. 62-178992. These devices consist of an oil permeation control layer adhered to a thick porous material which serves as a wick or reservoir for supplying oil to the permeation control layer. The permeation control layer is typically a porous polytetrafluoroethylene film which has been impregnated with a mixture of silicone oil and silicone rubber followed by a heat treatment to crosslink the silicone rubber. The thick porous material to which the permeation control layer is adhered is typically porous polytetrafluoroethylene tubing or felts of Nomex (TM) fibers, glass fibers, carbon fibers, or polytetrafluoro-ethylene fibers.

The devices described in Japanese Laid-Open Patent Application Publication No. 62-178992 meter and uniformly coat roll surfaces with release liquids at rates of 0.3 to 1.0 microliters/A4 size paper copy. They have been used successfully in copying machines and provide satisfactory performance until approximately 80,000 to 180,000 copies have been made. At this time, usually due to deformation and failure of the thick porous material supporting the permeation control layer or to separation of the permeation control layer from the thick porous layer, they can no longer perform acceptably and must be replaced.

In U.S. Pat. No. 5,232,499 to Kato et al. an improved device to meter and uniformly coat a surface with a release liquid is described. The device includes a liquid permeation control layer adhered to a porous support, the porous support also serving as a reservoir to supply a release liquid to the permeation control layer. Again, the permeation control layer is typically a porous polytetrafluoro-ethylene film which has been impregnated with a mixture of silicone oil and silicone rubber followed by a heat treatment to crosslink the silicone rubber. In this device, however, a rigid open-celled thermosetting polymer foam is used as a support material, and is filled with a mixture of silicone oil and silicone rubber which can reinforce the thermosetting polymer foam and provide oil to be supplied to the permeation control layer. This device meters and uniformly coats roll surfaces with release liquids at rates of 0.1 to 0.3 microliters/A4 size paper copy, and is capable of long-term operation in the temperature range of 150° C. to 200° C. They have been used successfully in copying machines, at an operating temperature range of 150° C. to 200° C., and provide satisfactory performance until more than 500,000 copies have been made. However, they lack the temperature resistance and durability required for use in high-speed copiers having operating temperatures in the range 200° C. to 250° C., and maintenance-free expectation of 700,000 to 1,000,000 copies. If used at operating temperatures of 200° C. to 250° C. premature failure due to deformation of the the thermosetting polymer foam, or separation of the permeation control layer from the support material occurs, and the device must be replaced with unacceptable frequency.

It is a purpose of this invention to provide a device for metering and coating a liquid on to a surface, for example, to the surface of toner image fixation rolls in a plain paper copying machine, at an operating temperature in the range 200° C. to 250° C., with exceptional accuracy, uniformity, and durability.

SUMMARY OF THE INVENTION

The present invention is an improved liquid metering and coating device which can satisfactorily perform the operation of applying a release liquid to a surface, for example, to toner fixation rolls of a plain paper copying machine, at an operating temperature in the range 200° C. to 250° C. for a sufficient length of time to produce 700,000 to 1,000,000 copies.

One embodiment of the invention comprises a porous permeation control material comprising porous polytetrafluoroethylene adhered to the outer surface of a porous open-celled support material of silicone rubber foam. The pores of the support material contain a first oil supply mixture of silicone oil and silicone rubber, a portion of said silicone rubber being bonded to the internal surface of said silicone rubber support material. The pores of the porous polytetrafluoroethylene permeation control material may contain silicone rubber, or a second mixture of silicone oil and silicone rubber; a portion of said silicone rubber in the permeation control material being bonded to a portion of the silicone rubber of the first mixture contained in the silicone rubber support material. The ratio of silicone oil to silicone rubber in said permeation control material is less than the ratio of silicone oil to silicone rubber in said support material.

Another embodiment of the invention comprises a porous permeation control material comprising porous polytetrafluoroethylene adhered to the outer surface of a porous open-celled support material of synthetic polymer material, said support material having applied to its outer surface a coating of silicone rubber. Said silicone rubber coating material forced into and penetrating into the pores of the surface region of said support material to a depth of five percent or more of the thickness of said support material and providing reinforcement to the support material. The pores of the support material containing a first oil supply mixture of silicone oil and silicone rubber, a portion of said silicone rubber being bonded to said silicone rubber of said reinforcing material. The pores of the porous polytetrafluoroethylene permeation control material may contain silicone rubber, or a second mixture of silicone oil and silicone rubber; a portion of said silicone rubber contained in the pores of said permeation control material being bonded to a portion of the silicone rubber of the reinforcing material. The ratio of silicone oil to silicone rubber in said permeation control material is less than the ratio of silicone oil to silicone rubber contained in said support material.

Yet another embodiment of the invention comprises a porous permeation control material comprising porous polytetrafluoroethylene adhered to the outer surface of a porous open-celled support material of synthetic polymer material, said support material containing in the region near its outer surface a first mixture of silicone oil and silicone rubber. Said first mixture material penetrates into the pores of the surface region of said support material to a depth of five percent or more of the thickness of said support material and provides reinforcement to the support material. The pores of the support material also contain a second oil supply mixture of silicone oil and silicone rubber, a portion of said silicone rubber of said second mixture being bonded to said silicone rubber of said reinforcing material. The pores of the porous polytetrafluoroethylene permeation control material may contain silicone rubber, or a third mixture of silicone oil and silicone rubber; a portion of said silicone rubber contained in the pores of said permeation control material is bonded to a portion of the silicone rubber of the reinforcing material. The ratio of silicone oil to silicone rubber in said permeation control material is less than the ratio of silicone oil to silicone rubber in said reinforcing material, and the ratio of silicone oil to silicone rubber in said reinforcing material being less than the silicone oil to silicone rubber ratio in the oil supply reservoir material contained in the pores of said support material.

Thus, the embodiments of the invention are characterized in that a portion of the silicone rubber network of any region is bonded to a portion of the silicone rubber network in the adjoining region so that an interconnected network of silicone rubber is continuous throughout the device. Furthermore, the ratio of silicone oil to silicone rubber in the mixtures contained in the pores of the device are adjusted so that through the device, in a direction away from the outer surface of the permeation control material, increasing amounts of silicone oil are present, such that silicone oil contained in the support material is supplied to the permeation control layer, and thence through the permeation control layer to a contacting surface.

DETAILED DESCRIPTION OF THE INVENTION

Figure 1:
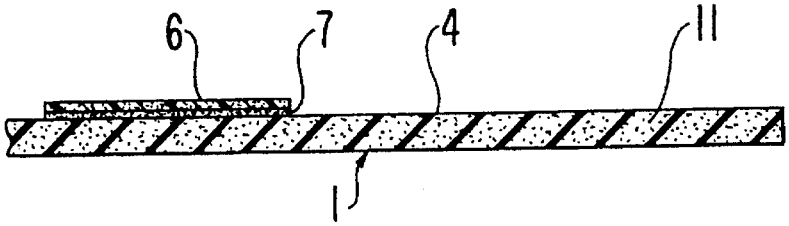
FIG. 1 is a cross-sectional view of an embodiment of the invention in the form of a wicking device.
Figure 2A:
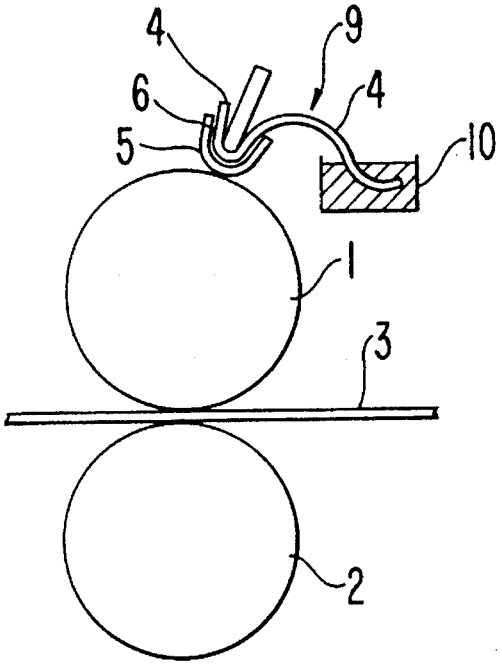
FIGS. 2A and 2B are side and front schematic views of a toner fixation mechanism of a PPC machine incorporating the embodiment of FIG. 1.
Figure 2B:
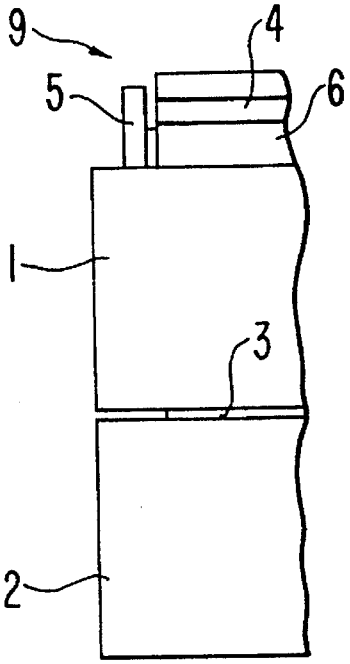

Shown in FIG. 1 is a liquid metering and coating device of the invention in the form of a wicking device and, in FIGS. 2A and 2B, the device is shown schematically as part of a toner fixation assembly 9 of a PPC copying machine. The wicking embodiment shown in FIG. 1 comprises a porous permeation control material 6 comprising porous polytetrafluoroethylene material adhered to a porous open-celled support material 4 of silicone rubber foam by a porous layer of adhesive 7. Contained in the pores of the support material 4 is a mixture of silicone oil and silicone rubber 11. Thus, support material 4 also serves as a reservoir from which the silicone oil of the mixture of silicone oil and silicone rubber 11 is supplied to the permeation control material 6. Additionally, as seen in FIG. 2A, the support material 4 serves as a wick along which silicone oil is drawn by capillary action from a source 10 to replenish the oil coated on a surface by the permeation control material 6. Referring to FIGS. 2A and 2B, the device of the invention is held in place by a support 5 and pressed with press plate 8 so that the oil permeation control material contacts, and coats with silicone oil release liquid, the surface of the heat fixing roll 1 of the toner fixation assembly 9. Paper 3, printed with toner images, is passed through the nip formed by the heat fixing roll 1 and pressure roll 2 of the toner fixation assembly, and the toner images fixed in place.

The porous support material 4 is an open-celled foam of silicone rubber. The silicone rubber can be a room temperature vulcanizing (RTV) type, low temperature vulcanizing (LTV) type, high temperature vulcanizing (HTV) type, or ultra-violet radiation curing type. The open-celled foam of silicone rubber should have a pore volume of at least 40 percent, preferably in the range 60 to 99.9 percent. Open-celled foams with pore volumes less than 40 percent have inadequate liquid holding capacity and may have structures that restrict liquid movement through them. Open-celled foams with pore volumes greater than 99.9 percent have such an open, weak structure that, even when reinforced, durability is too difficult to obtain. Surface hardness of the foam should be 70 degrees or less, preferably 50 degrees or less, as measured by Japan Rubber Association Standard SRIS-0101. Furthermore, the open-celled silicone rubber foam must be chemically compatible with and wettable by the liquids of use, and must have sufficient strength and heat resistance for operation in the temperature range 200° C. to 250° C.

The liquid permeation control material 6 is prepared by adhering a porous polytetrafluoroethylene material to the surface of the porous support material 4 using a porous layer 7 of adhesive material. Porous polytetrafluoroethylene membranes suitable for use in the invention can be made by processes known in the art, for example, by papermaking processes, or by processes in which filler materials are incorporated with the PTFE resin and which are subsequently removed to leave a porous structure. Preferably the porous polytetrafluoroethylene membrane is porous expanded polytetrafluoroethylene membrane having a structure of interconnected nodes and fibrils, as described in U.S. Pat. Nos. 3,953,566, 3,962,153, 4,096,227, and 4,187,390 which fully describe the preferred material and processes for making them. Most preferably, the permeation control material 6 is porous expanded polytetrafluoroethylene film which is impregnated, and its pores substantially filled, with a mixture of silicone oil and silicone rubber as described in Japanese Laid-Open Patent Application Publication No. 62-178992. The porous polytetrafluoroethylene membrane of the permeation control material should have a thickness in the range 1 to 1,000 micrometers, preferably in the range 5 to 100 micrometers; a pore volume in the range 20 to 98 percent, preferably in the range 50 to 90 percent; and a nominal pore size in the range 0.05 to 15 micrometers, preferably in the range 0.1 to 2 micrometers.

The adhesive is preferably a thermoplastic or thermosetting synthetic polymer material, although other types of adhesives may be used so long as they have the heat resistance, durability, and chemical compatibility for an intended end use. The adhesive can be applied to form a porous layer by conventional means, for example, by spraying, coating or gravure printing methods; or by use of a porous mesh or nonwoven web, and the like, interposed between the materials to be joined.

An oil supply reservoir 11 comprising a mixture of silicone oil and silicone rubber is then formed internally within the porous support material 4 by impregnating a mixture of silicone oil and cross-linking silicone rubber into the porous support material, after which the silicone rubber is cross-linked, for example by heating, to form a gel. The amount of silicone oil in the mixture should be in the range 10 percent to 98 percent by weight, preferably in the range 50 percent to 95 percent by weight. When the amount of silicone oil in the mixture is less than about 10 wt. % the mobility of the liquid is limited and transfer of the oil to the permeation control material 6 is excessively slow. When the amount of silicone oil in the mixture exceeds 98 wt. % there is too little gel formed by the cross-linking silicone rubber and the oil will leak from the porous support material 4.

The amount of the silicone oil and silicone rubber mixture impregnated into the porous silicone rubber foam support material 4 to form the liquid supply reservoir 11 should be such that 30 percent to 90 percent, preferably 50 percent to 80 percent, of the pore volume of the silicone rubber foam is filled. When more than 90% of the pore volume of the support material 4 is filled there is insufficient remaining volume to accommodate expansion of the mixture if it is heated to effect cross-linking, and leakage may occur. When less than 30% of the pore volume of the support material is filled there is insufficient oil present to provide an adequate operating life span to the device.

The cross-linking silicone rubber of the silicone oil and silicone rubber mixture of the oil supply reservoir 11 can be of the types listed above. The silicone oil of the silicone oil and silicone rubber mixture is preferably dimethyl silicone oil, which is favored for use in PPC copiers for its release and abrasion resistant properties. Likewise, when the oil permeation control material 6 comprises porous polytetrafluoroethylene membrane impregnated with a mixture of silicone oil and silicone rubber the same types of silicone oil and silicone rubber can be used. However, substantially all of the pore volume of the permeation control material 6 should be filled with the mixture, and the silicone oil content of the mixture in the permeation control material 6 must be less than the silicone oil content of the silicone oil and silicone rubber mixture contained in the porous support material 4.

The liquid metering and coating device formed as described above can be used as depicted or, alternatively, the materials can be combined to form a composite sheet in which the permeation control layer 6 is extended to fully cover one surface of the support material 4 and the ends of the composite sheet joined, for example, to form a belt. In a further configuration, the materials can be combined to provide a liquid metering and control device in the form of a roll, as shown in FIG. 3 and described hereinbelow.

Figure 3:
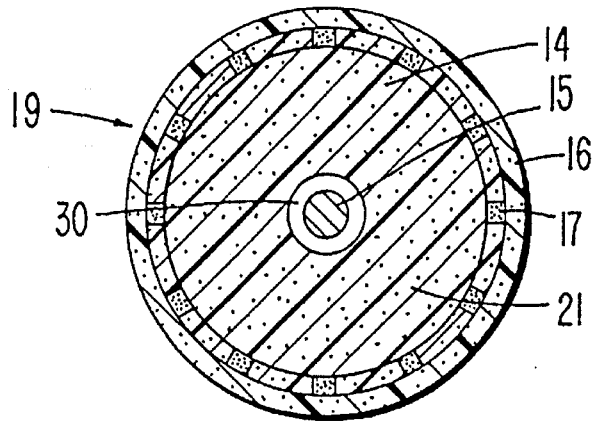
FIG. 3 is a cross-sectional view of an embodiment of the invention in the form of a roll.

FIG. 3 shows an embodiment of the invention in the form of a roll. The liquid metering and coating roll 19 is prepared by first axially mounting a tubular porous support material 14 of open-celled silicone rubber foam on a metal shaft 15. The open-celled silicone rubber foam can be of the same types of silicone rubber used in the embodiment described hereinabove, and should also have a pore volume of at least 40%, preferably in the range 60% to 99.9%.

A liquid permeation control material 16 is prepared by wrapping a porous polytetrafluoroethylene membrane around and adhering it to the surface of the tubular porous support material 14 using a porous layer of adhesive 17. The polytetrafluoroethylene material and adhesive material are as described earlier, and are also disclosed in U.S. Pat. No. 5,232,499 to Kato, et al. Preferably, the porous polytetrafluoroethylene membrane is substantially filled with a mixture of silicone oil and silicone rubber as described above.

An oil supply reservoir 21 is then formed internally within the porous support 14 by introducing a mixture of silicone oil and silicone rubber into the end of the porous support 14 and spinning the support about its axis, thus using centrifugal force to direct the mixture outwardly within the support to a region contiguous with the permeation control material 16 and leaving a region 30 of the porous support 14 unfilled by the mixture, as taught in U.S. Pat. No. 5,232,499. Gelation of the mixture forming the oil supply layer is then effected by crosslinking the silicone rubber. As with the embodiment described earlier, the amount of silicone oil in the mixture should be in the range 10 wt. % to 98 wt. %, preferably in the range 50 wt. % to 95 wt. %. When the amount of silicone oil in the mixture is less than about 10 wt. % the mobility of the liquid is limited and transfer of the oil to the permeation control material 16 is excessively slow. When the amount of silicone oil in the mixture exceeds 98 wt. % there is too little gel formed by the cross-linking silicone rubber and the oil will leak from the porous support material 14. Also as above, and for the same reasons, the amount of the silicone oil and silicone rubber mixture impregnated into the porous silicone rubber foam support material 14 to form the liquid supply reservoir 21 should be such that 30 percent to 90 percent, preferably 50 percent to 80 percent, of the pore volume of the silicone rubber foam is filled.

The cross-linking silicone rubber of the silicone oil and silicone rubber mixture of the oil supply reservoir 21 can be of the types listed above. The silicone oil of the silicone oil and silicone rubber mixture is preferably dimethyl silicone oil, which is favored for use in PPC copiers for its release and abrasion resistant properties. Likewise, when the oil permeation control material 16 comprises porous polytetrafluoroethylene membrane impregnated with a mixture of silicone oil and silicone rubber the same types of silicone oil and silicone rubber can be used. However, as with the embodiment described above, substantially all of the pore volume of the permeation control material 16 should be filled with the mixture, and the silicone oil content of the mixture in the permeation control material 16 must be less than the silicone oil content of the silicone oil and silicone rubber mixture contained in the porous support material 14.

The embodiments of the invention described hereinabove are characterized in that all incorporate in their construction high temperature resistant silicone oil and silicone rubber that can be used for extended periods of time without deteriorating at operating temperatures in the range 200° C. to 250° C. It has been found that a portion of the cross-linked silicone rubber network of any region is strongly bonded to a portion of the cross-linked silicone rubber network in the adjoining region, or to the open-celled silicone rubber foam of the porous support material, so that an interconnected network of silicone rubber is continuous throughout the device. The reason for this strong bonding is not definitely known as it would seem that, after cross-linking, there should be no functional groups left in the silicone rubber for chemical bonding to another previously cross-linked silicone rubber. It may be due to an affinity between cross-linked silicone rubbers in close proximity. However, it is apparent from comparison of examples of the invention with the comparative example described hereinbelow, that the bonding between the cross-linked silicone rubbers used in the invention is strong.

It has been further determined that the strong bonding mechanism promotes use of a porous reinforcing region comprising silicone rubber that strengthens the porous support material of silicone rubber foam, as well as support material of other synthetic polymers, so that porous support materials having very high pore volumes, for example, greater than 90%, and thus higher liquid holding capacity, can be used. An embodiment of the invention having a reinforcing region is shown in FIG. 4 and described hereinbelow.

Figure 4:
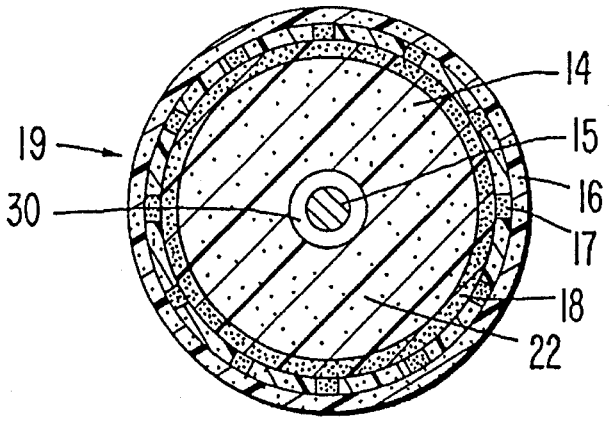
FIG. 4 is a cross-sectional view of another embodiment of the invention in the form of a roll.

FIG. 4 shows an embodiment of the invention also in the form of a roll. The liquid metering and coating roll 19 is prepared by first axially mounting a non-rigid tubular porous support material 14 on a metal shaft 15. The porous support material should be an open-celled foam or other continuous pore structure having a pore volume of at least 40 wt. %, preferably in the range 80 wt. % to 99.9 wt. %. As stated earlier, porous support materials having pore volumes less than 40 percent have inadequate liquid holding capacity and may have structures that restrict liquid movement through them. Materials with pore volumes greater than 99.9 percent have such an open, weak structure that, even when reinforced, durability is too difficult to obtain. The porous support material 14 should have a surface hardness of the foam 70 degrees or less, preferably 50 degrees or less, as measured by Japan Rubber Association Standard SRIS-0101. Furthermore, the porous support material must be chemically compatible with and wettable by the liquids of use, and must have sufficient strength and heat resistance for operation in the temperature range 200° C. to 250° C. Suitable non-rigid porous materials are commercially available and, in addition to silicone rubber as described above, can be of synthetic polymers such as, for example, polyester polyurethane, polyether polyurethane, polyvinyl chloride, polyethylene, polystyrene, and the like. By non-rigid is meant that the material is not a hard, stiff, brittle material.

A porous reinforcing region 18 comprising cross-linked silicone rubber is formed internally within the porous support material 14 contiguous to the permeation control material 16. The reinforcing 18 region provides effective reinforcement to the device through its affinity and bonding with the cross-linked silicone rubber comprised in the permeation control material 16, to the porous support material 14, and with the cross-linked silicone rubber of the reservoir 22 contained in the porous support material. The reinforcing material adds strength and elasticity to the device, and improves compliance of the oil permeation control material 16 to the surface to be coated.

The reinforcing region 18 should have a thickness of 5% to 50%, preferably 10% to 20%, of the thickness of the porous support material 14. When the thickness of the reinforcing region is less than 5% of the thickness of the support material it is too thin to provide effective reinforcement. When the thickness of the reinforcing region is greater than 50% of the thickness of the support material the resistance to permeation of oil supplied from the oil supply reservoir 22 is excessive. The reinforcing region 18 can be formed of silicone rubber or from a mixture of silicone oil and silicone rubber.

A reinforcing region 18 can be formed by coating the surface of the porous support material 14 with a coating of silicone rubber which is then forced into the pores of the surface region of the porous support material 14 to a depth of at least 5% of the thickness of the support material. The silicone rubber coating should be applied to the surface of the porous support material 14 in an amount in the range 50 to 300 kg/m$^3$, preferably in the range 100 to 200 kg/m$^3$. The coating is then forced into the surface region of the porous support material 14 in a manner such that porosity, i.e., a continuous network of interconnected pores, is maintained through the reinforcing region so that oil supplied from the oil supply reservoir 22 can pass through it to enter the permeation control material 16. Such a method of coating a non-rigid porous material is disclosed in Japanese Laid-Open Patent Application Publication 58-17129.

A liquid permeation control material 16 is then prepared by wrapping a porous polytetrafluoroethylene membrane around and adhering it to the surface of the tubular porous support material 14 using a porous layer of adhesive 17, in the manner and with the materials used to prepare the roll described hereinabove.

When the reinforcing material region 18 is formed by a mixture of silicone oil and silicone rubber, the liquid permeation control material 16 is adhered to the porous support material 14 by a porous layer of adhesive 17 prior to the formation of the reinforcing region. Then, as disclosed in U.S. Pat. No. 5,232,499, a reinforcing region 18 is formed internally within the porous support 14 contiguous to the permeation control layer 16 by introducing a mixture of silicone oil and silicone rubber into the end of the porous support 14 and spinning the support about its axis, thus using centrifugal force to direct the mixture outwardly within the porous support to form a region of uniform thickness contiguous with the inside surface of the permeation control layer 16, after which it is immobilized by crosslinking the silicone rubber.

The silicone oil content of the silicone oil and silicone rubber mixture forming the reinforcing region 18 should be no more than 50 wt. %, preferably 30 wt. % or less. When the silicone rubber content of the mixture is less than about 50 wt. % the coating and bonding effect to the porous support material is reduced, as is the bonding to the cross-linked silicone rubber of the adjoining regions, and insufficient strength, heat resistance, and durability is developed to provide good reinforcement.

An oil supply reservoir 22 is then formed internally within the porous support 14 by introducing a mixture of silicone oil and silicone rubber into the end of the porous support material 14 and spinning the support about its axis, thus using centrifugal force to direct the mixture outwardly within the support material to a region contiguous with the permeation control material 16 and leaving a region 30 of the porous support 14 untilled by the mixture, as taught in U.S. Pat. No. 5,232,499. Gelation of the mixture forming the oil supply layer is then effected by crosslinking the silicone rubber. As with the embodiment described earlier, the amount of silicone oil in the mixture should be in the range 10 percent to 98 percent by weight, preferably in the range 50 percent to 95 percent by weight. When the amount of silicone oil in the mixture is less than about 10 wt. % the mobility of the liquid is limited and transfer of the oil through the reinforcing region 18 and into the permeation control material 16 is excessively slow. When the amount of silicone oil in the mixture exceeds 98 wt. % there is too little gel formed by the cross-linking silicone rubber and the oil will leak from the porous support material 4.

The silicone oil and cross-linking silicone rubber of the silicone oil and silicone rubber mixture of the oil supply reservoir 22 are as described above. Likewise, when the oil permeation control material 16 comprises porous polytetrafluoroethylene membrane impregnated with a mixture of silicone oil and silicone rubber the same types of silicone oil and silicone rubber can be used. However, as with the embodiment described above, substantially all of the pore volume of the permeation control material 16 should be filled with the mixture. When the reinforcing material is silicone rubber only the silicone oil content of the mixture in the permeation control material 16 must be less than the silicone oil content of the silicone oil and silicone rubber mixture contained in the porous support material 14. When the reinforcing material region 18 is formed by a mixture of silicone oil and silicone rubber the silicone oil content of the permeation control material 16 must be less than the silicone oil content of the reinforcing material region 18, and the silicone oil content of the reinforcing region 18 must be less than the silicone oil content of the oil supply material 22.

Figure 5A:
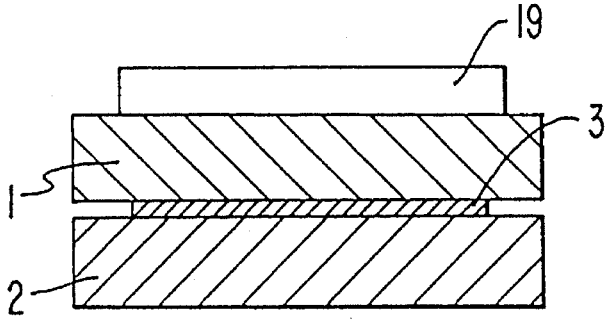
FIGS. 5A and 5B are side and front schematic views of a toner fixation mechanism of a PPC machine incorporating the embodiment of FIG. 3 or FIG. 4.
Figure 5B:
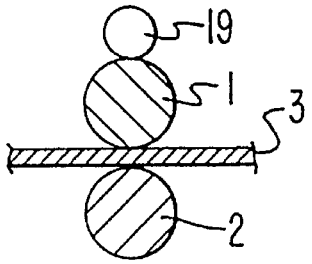

In FIGS. 5A and 5B the liquid metering and coating device 19 of the invention is shown schematically as part of a toner image fixation mechanism of a PPC machine. The liquid metering and coating device 19 is shown in contact with the thermal fixation roll 1 against which a recording medium 3 carrying an unstabilized toner image is being forced by the pressure roll 2.

The liquid metering and coating devices described above have high oil holding capacity for long service life, good elasticity and recovery characteristics for compliance to surfaces and shape retention, and are formed of materials in a manner that permits operation at temperature in the range 200° C. to 250° C. The following examples further illustrate embodiments of the invention.

EXAMPLE 1

A liquid metering and coating device 19 as shown in FIG. 3 was prepared as follows:

An 8 mm diameter steel shaft 15 was inserted axially into a porous support material 14 of open-celled silicone rubber foam. The silicone rubber foam support material had an outer diameter of 27 mm, an inner diameter of 8 mm, surface hardness of 28 degrees, bulk density of 230 kg/cubic meter, and a pore volume of 82%.

A porous expanded polytetrafluoroethylene membrane having a thickness of about 30 micrometers, a nominal pore size of 0.5 micrometers, and a pore volume of about 80%, was gravure printed on one side with a non-continuous pattern of 0.5 mm diameter dots of thermoplastic adhesive to form a porous layer of adhesive 17 on the membrane. A permeation control material 16 was formed by first wrapping a single layer of the adhesive printed membrane around the porous support material 14 and thermally fusing it in place by application of heat and pressure.

A mixture of 20 wt. % silicone oil (KF-96, manufactured by Shin-Etsu Chemical Co., Ltd. and used as a releasing agent) and 80 wt. % silicone rubber (KE-106, manufactured by Shin-Etsu Chemical Co., Ltd.) was prepared. The porous expanded polytetrafluoroethylene film was impregnated with the silicone oil and silicone rubber mixture after which the excess mixture was removed from the film surface and the assembly heated at 150° C. for 40 minutes to crosslink the silicone rubber, thus completing formation of the permeation control material 16.

A second mixture of the silicone oil and silicone rubber described above, having a silicone oil content of 90 wt. % and silicone rubber content of 10 wt. %, was poured into the end of the porous support body 14 and, by spinning the assembly about its axis, was directed outwardly through the porous support body to form an oil-supply reservoir 21 contiguous with the permeation control material 16 and leaving a section 30 of the porous support body 14 untilled by the mixture. The assembly was then heated at 150° C. for 80 minutes to crosslink the silicone rubber and cause gelation in the oil-supply layer 21.

The liquid metering and coating device was tested in a plain paper copying machine in which the surface temperature of the heat fixing roll was 230° C. and the copying speed was 80 sheets/minute of A4 size paper. Initially, the device applied oil at the rate of 0.1 microliter/A4 size copy. Oil application amounts of 0.1 to 0.2 microliters/A4 size copy were determined from sequential measurements of increments of 20,000 copies until 1,000,000 copies were made. No change in the appearance or shape of the device occurred. After testing the device was sectioned and examined by microscope, whereby it was confirmed that portions of the silicone rubber of the mixtures had bonded, and that portions of the silicone rubber of the mixture contained in the porous support material had bonded to the internal surfaces of the porous support material.

EXAMPLE 2

A liquid metering and coating device 19 as shown in FIG. 4 was prepared as follows:

An 8 mm diameter steel shaft 15 was inserted axially into a porous support material 14 of open-celled polyester polyurethane foam. The polyester polyurethane foam support material had an outer diameter of 27 mm, an inner diameter of 8 mm, surface hardness of less than 1 degree, bulk density of 30 kg/cubic meter, and a pore volume of 98%.

A reinforcing region 18 was prepared as follows:

A predetermined amount of addition reaction hardening silicone rubber (KE1300, manufactured by Shin-Etsu Chemical Co., Ltd.) was poured on a plate glass surface. The polyester polyurethane foam support material 14 was rolled in the liquid silicone rubber until it was impregnated into the porous support material. The impregnated support material was then repeatedly rolled on a corrugated surface causing it to flex, thus distributing the liquid silicone rubber in the pores of the support material so as to coat the internal surfaces of the porous support material and thereby maintaining internal porosity of interconnected pores through the reinforcing region 18. The reinforced porous support material had a surface hardness of 12 degrees, bulk density of 100 kg/cubic meter, and a pore volume of 90%.

A permeation control material 16 comprising a porous polytetrafluoroethylene membrane having a thickness of about 30 micrometers, a nominal pore size of 0.4 micrometers, and a pore volume of about 80% was prepared as described in Example 1. Then, an oil supply reservoir 22 was prepared, also as described in Example 1.

The liquid metering and coating device was tested in a plain paper copying machine in which the surface temperature of the heat fixing roll was 230° C. and the copying speed was 80 sheets/minute of A4 size paper. Initially, the device applied oil at the rate of 0.1 microliter/A4 size copy. Oil application amounts of 0.1 to 0.2 microliters/A4 size copy were determined from sequential measurements of increments of 20,000 copies until 1,000,000 copies were made. No change in the appearance or shape of the device occurred. After testing the device was sectioned and examined by microscope, whereby it was confirmed that the addition reaction hardening silicone rubber had coated the internal surfaces of the porous support material in the reinforcing region, and that portions of the silicone rubber of the silicone oil and silicone rubber mixtures had bonded to portions of the internal surfaces of the reinforcing material.

Comparative Example 1

An 8 mm diameter steel shaft was inserted axially into a porous support material 14 of open-celled melamine resin. The melamine resin foam support material had an outer diameter of 27 mm, an inner diameter of 8 mm, surface hardness of 10 degrees, bulk density of 11 kg/cubic meter, and a pore volume of 99%.

A permeation control material and an oil supply reservoir were prepared of the materials and in the manner described in Example 1.

The comparative liquid metering and coating device was tested in a plain paper copying machine in which the surface temperature of the heat fixing roll was 230° C. and the copying speed was 80 sheets/minute of A4 size paper. Initially, the device applied oil at the rate of 0.1 microliter / A4 size copy. However, the oil permeation control material peeled after 300,000 copies, and then broke and became unusable. After testing the device was sectioned and examined by microscope, whereby it was observed that slight voids existed between the internal surfaces of the porous support material and the silicone rubber of the silicone oil and silicone rubber mixture.

We claim:

1. A liquid metering and coating device comprising (a) a porous permeation control material comprising porous polytetrafluoroethylene adhered to the outer surface of (b) a porous open-celled support material of silicone rubber foam containing in its pores (c) a first mixture of silicone oil and cross-linked silicone rubber, wherein portions of said cross-linked silicone rubber of said first mixture are bonded to an internal surface of said silicone rubber support material.

2. The liquid metering and coating device as recited in claim 1 wherein pores of the porous permeation control material contain a second mixture of silicone oil and silicone rubber, said second mixture having a silicone oil to silicone rubber ratio less than the silicone oil to silicone rubber ratio of said first mixture, and wherein portions of said silicone rubber of said second mixture are bonded to portions of said silicone rubber of said first mixture.

3. The liquid metering and coating device as recited in claim 1 wherein pores of the porous permeation control material contain silicone rubber, wherein portions of said silicone rubber in said porous permeation control material are bonded to portions of said silicone rubber in said support material.

4. The liquid metering and coating device as recited in claims 1, 2, or 3, wherein the porous permeation control material comprises porous expanded polytetrafluoroethylene.

5. A liquid metering and coating device comprising (a) a porous permeation control material comprising porous polytetrafluoroethylene adhered to an outer surface of (b) a porous open-celled support material of synthetic polymer material;

said support material having region pores penetrated to a depth of five percent or more of the thickness of said support material with a reinforcing material comprising silicone rubber, and said support material containing in its pores a first mixture of silicone oil and silicone rubber wherein portions of said silicone rubber of said mixture of silicone oil and silicone rubber are bonded to portions of said silicone rubber of said reinforcing material of said support material.

6. The liquid metering and coating device as recited in claim 5 wherein the pores of porous permeation control material contain a second mixture of silicone oil and silicone rubber, said second mixture having a silicone oil to silicone rubber ratio less than the silicone oil to silicone rubber ratio of said first mixture, and wherein portions of said silicone rubber of said second mixture are bonded to portions of said silicone rubber of said reinforcing material.

7. The liquid metering and coating device as recited in claim 5 wherein pores of the porous permeation control material contain silicone rubber, wherein portions of said silicone rubber in said porous permeation control material are bonded to portions of said silicone rubber in said reinforcing material.

8. The liquid metering and coating device as recited in claims 5, 6, or 7, wherein the porous permeation control material comprises porous expanded polytetrafluoroethylene.

9. A liquid metering and coating device comprising (a) a porous permeation control material comprising porous polytetrafluoroethylene adhered to an outer surface of (b) a porous open-celled support material of synthetic polymer material;

said support material having pores penetrated to a depth of five percent or more of the thickness of said support material with a reinforcing material of a first mixture of silicone oil and silicone rubber, and said support material containing in its pores a second mixture of silicone oil and silicone rubber said second mixture having a silicone oil to silicone rubber ratio more than the silicone oil to silicone rubber ratio of said first mixture, wherein portions of said silicone rubber of said second mixture of silicone oil and silicone rubber are bonded to portions of said silicone rubber of said reinforcing material of said support material.

10. The liquid metering and coating device as recited in claim 9 wherein the pores of porous permeation control material contain a third mixture of silicone oil and silicone rubber, said third mixture having a silicone oil to silicone rubber ratio less than the silicone oil to silicone rubber ratio of said first mixture of said reinforcing material, and wherein portions of said silicone rubber of said third mixture are bonded to portions of said silicone rubber of said first mixture of said reinforcing material.

11. The liquid metering and coating device as recited in claim 9 wherein pores of the porous permeation control material contain silicone rubber, wherein portions of said silicone rubber in said porous permeation control material are bonded to portions of said silicone rubber in said reinforcing material.

12. The liquid metering and coating device as recited in claims 9, 10, or 11, wherein the porous permeation control material comprises porous expanded polytetrafluoroethylene.

* * * * *